US010850970B2

(12) United States Patent
Schmidt

(10) Patent No.: US 10,850,970 B2
(45) Date of Patent: Dec. 1, 2020

(54) METHOD AND APPARATUS FOR DIRECT GRAVITY-FED FUEL DELIVERY

(71) Applicant: Gravity Fuel Systems, LLC, Lafayette, LA (US)

(72) Inventor: Brennan Schmidt, Weatherford, OK (US)

( * ) Notice: Subject to any disclaimer, the term of this patent is extended or adjusted under 35 U.S.C. 154(b) by 0 days.

(21) Appl. No.: 16/416,729

(22) Filed: May 20, 2019

(65) Prior Publication Data

US 2019/0359475 A1 Nov. 28, 2019

Related U.S. Application Data

(60) Provisional application No. 62/674,331, filed on May 14, 2018.

(51) Int. Cl.

| | |
|---|---|
| ***B67D 7/04*** | (2010.01) |
| ***B67D 7/36*** | (2010.01) |
| ***B67D 7/58*** | (2010.01) |
| ***B67D 7/78*** | (2010.01) |

(52) U.S. Cl.

CPC ..... *B67D 7/04* (2013.01); *B67D 7/36* (2013.01); *B67D 7/58* (2013.01); *B67D 7/78* (2013.01)

(58) Field of Classification Search

CPC ... B67D 7/04; B67D 7/36; B67D 7/58; B67D 7/78; B67D 7/845

USPC ..... 141/231, 290

See application file for complete search history.

(56) References Cited

U.S. PATENT DOCUMENTS

| | | | | |
|---|---|---|---|---|
| 1,263,810 | A | 4/1918 | Sauermann | |
| 1,734,604 | A | 11/1929 | Smith | |
| 3,185,173 | A | 5/1965 | Pase | |
| 6,450,196 | B1 | 9/2002 | Bartos et al. | |
| 6,619,341 | B2 | 9/2003 | Cushing | |
| 9,371,830 | B2 | 6/2016 | Moffitt, Jr. | |
| 9,371,831 | B2 | 6/2016 | Moffitt, Jr. | |
| 9,751,749 | B1 * | 9/2017 | Moffitt, Jr. | F04B 47/04 |
| 9,802,809 | B1 * | 10/2017 | Schultz, Jr. | B65D 25/48 |
| 9,856,131 | B1 | 1/2018 | Moffitt, Jr. | |
| 10,017,374 | B1 | 7/2018 | Moffitt, Jr. | |
| 10,106,396 | B1 | 10/2018 | Moffitt, Jr. | |
| 2006/0124807 | A1 | 6/2006 | Nice | |

(Continued)

OTHER PUBLICATIONS

International Search Report and Written Opinion for International Application No. PCT/US2019/033089 dated Jul. 25, 2019; pp. 1-14.

*Primary Examiner* — Timothy P. Kelly
*Assistant Examiner* — Christopher M Afful
(74) *Attorney, Agent, or Firm* — Bracewell LLP

(57) ABSTRACT

A gravity-fed fuel delivery system is provided. A central storage tank holds fuel to re-supply a number of pump trucks or other mechanized equipment, such as on a hydraulic fracturing location, and can be selectively raised or lowered. Hoses or other conduits extend from the central storage tank to individual engines of the equipment to be refueled. Adapters allow connection of the distal end of each hose or conduit to an inlet of the suction side of the engine. Adaptors also allow connection of the return side of the engine's fuel system back to the central storage tank. Thereby mechanically allowing flow from the central storage tank, through the engine's fuel system, supply fuel for the engine to burn and allowing the return or unburned fuel a path back to the central storage tank.

12 Claims, 6 Drawing Sheets

(56) References Cited

U.S. PATENT DOCUMENTS

| | | | | |
|---|---|---|---|---|
| 2011/0197988 | A1 | 8/2011 | Van Vliet et al. | |
| 2011/0220243 | A1* | 9/2011 | Szabo ..... | A01C 23/045 141/266 |
| 2016/0076532 | A1 | 3/2016 | Moffitt, Jr. | |
| 2017/0275149 | A1 | 9/2017 | Schmidt | |

* cited by examiner

METHOD AND APPARATUS FOR DIRECT GRAVITY-FED FUEL DELIVERY

BACKGROUND OF THE INVENTION

Field of the Invention

The present invention pertains to a fuel delivery assembly for delivering fuel in a controlled manner to equipment, including, but not limited to, hydraulic fracturing pumps and related equipment in the oil and gas industry. More particularly, the present invention pertains to a fuel delivery assembly for providing a gravity-fed fuel supply to hydraulic fracturing equipment in the oil and gas industry.

Brief Description of the Prior Art

Geological formations may contain deposits of oil and/or natural gas. However, in many cases such geologic formations have low permeability; due to such low permeability, hydrocarbon deposits may not flow from said geological formations at a desired flow rate. As a result, hydraulic fracturing ("fracking") is frequently employed to artificially produce fractures in such geological formations to stimulate the flow of natural gas or oil to wellbores penetrating the formations, thereby increasing the volumes of hydrocarbons that can be recovered.

Generally, the fracking process occurs after a well has been drilled to a desired depth and a steel casing has been installed into a wellbore. Such casing is perforated within a target formation (typically, but not always, a low permeability shale formation) that contains oil or gas. Fracturing fluid is injected into a well at high pressure and flows through the perforations and into the surrounding formation; in many case, the fracturing fluid typically includes water, proppant, and a number of chemical additives that open and enlarge fractures within the rock formation.

Fracturing fluid is pumped into a wellbore at a rate that is sufficient to increase pressure at the target depth (which is generally determined by the location of the well casing perforations), and eventually, the target formation will not be able to absorb the fluid as quickly as it is being injected. At this point, the pressure created exceeds that of the fracture gradient (pressure gradient) of the rock and causes the formation to crack or fracture. Once the fractures have been created, injection ceases and the fracturing fluids begin to flow back to the surface. Materials that are generally called proppants (i.e., sand, ceramic pellets, or any other small incompressible particles), which were injected as part of the fracturing fluid mixture, remain in the target formation to hold open the newly created fractures.

Hydraulic fracturing equipment used during fracturing operations typically includes a slurry blender, at least one high-pressure, high-volume fracturing pump, and a monitoring unit. Additionally, a variety of associated equipment is typically used in fracking operations, including, but not limited to, at least one storage unit and a plurality of hoses and gauges that can operate over a range of pressures and injection rates. Much of this equipment is powered by gas or diesel powered engines.

In many cases, fuel is manually delivered to each of these engines. In other cases, fuel systems utilize one or more fuel pumps to deliver fuel to multiple equipment fuel tanks. Such conventional fuel systems typically include sensors, networks, touch screens, powered valves, switches, regulators, or other similar devices, in order to keep fuel tanks relatively full of fuel. Such conventional systems can be very complex and have a large number of potential failure points; in some cases, such fueling system include electronic sensors to electronically monitor fuel levels in each tank and remotely open and close valves in order to control fuel flow.

Fuel pump systems that employ electronic sensors typically require individual fuel lines from a main fueling unit to each individual fuel pump, and from each individual fuel pump to an equipment fuel tank, thereby resulting in significantly more hoses or conduits disposed across a location. Such additional hoses typically results in more potential failure points, more cost, and more labor expense.

Fuel pump systems that go straight to the engines are less reliable than a gravity fed system since they may rely on some type of power source, motor, pump, pressure regulator etc.

With manual refueling systems, personnel must remember to regularly refuel all equipment fuel tanks on location. If such personnel neglect or fail to refill any tank, one or more pumps or other critical pieces of equipment (such as, for example, a sand belt or blender) may run out of fuel. This can result in cutting stages of a fracking operation short or even causing severe damage to a well.

Thus, there is a need for a fuel delivery system that is safer, more reliable and less expensive to operate and maintain than conventional refueling systems.

SUMMARY OF THE INVENTION

The present invention includes a gravity-fed system for use in controlling fuel flow to fracking equipment. Broadly, the fuel delivery assembly includes a gravity supply unit, which can beneficially be an all-inclusive package that is able to fuel one complete fleet of fracking pump trucks as well as other ancillary equipment. Additionally, the gravity supply unit is beneficially equipped with a hydraulic power pack that can selectively raise and lower said bulk fuel storage tank and operate a plurality of stabilizing legs. Raising said bulk fuel storage tank to a desired elevation on a fracking location provides a sufficient gravity head to deliver fluid (typically fuel) from said bulk fuel to individual trucks and/or other equipment on a location.

In addition, the gravity supply unit includes a plurality of supply boxes in order to contain all necessary fixtures, connections, hoses and assemblies for an entire fracking operation.

In some embodiments, said gravity supply unit can be selectively raised to an elevation that is higher than a highest equipment fuel tank on location. The bulk tank can then feed a network of conduits, hoses or supply lines. All of the connections include a dry break, or a no-drip connection, in order to prevent any spills.

Additionally, by way of illustration, but not limitation, the fuel delivery assembly of the present invention utilizes dry break, or flat faced, connections to supply fuel directly to any engine on a frac location or in any other engine needing fueled.

The gravity fed system utilizes a supply line or conduit from the main bulk tank to each engine requiring fuel. The line ties into the engines fuel system suction. Instead of the engine sucking fuel out of the onboard tanks, it pulls fuel directly from the bulk tank.

The gravity fed system utilizes a supply line or conduit from the discharge side of the engines fuel system back to the bulk tank to allow the engine to naturally circulate fluid as it is designed.

If less backpressure is desired on the engines fuel system than having to overcome gravity pressure, then the fuel can be returned to a tank at a lower level than the gravity tank to reduce head pressure and then it can be pumped into the upper bulk tank by a secondary pump equipped on the gravity fed unit.

To protect the engines fuel system, a relatively low pressure relief valve may be utilized on the engine fuel system's discharge side. The relieved pressure can be discharged into the suction side supply line as it will overcome the gravity pressure and find the path of least resistance either through the engine or back to the gravity bulk tank. This pressure relief valve protects the fuel system and its components in the event that there is a blockage between the return side of the engine's fuel system and the bulk supply tank that would cause back pressure and potential damage to the engine's system.

In an alternative embodiment, the suction side of the tank is not completely bypassed, such that if supply flow is cut off from a hose being run over or a valve shut, the engine can start sucking fuel out of the on board tank. The line that goes from the suction tank to the engine may have a tee put in it with the gravity supply line hooked into the tee and the line from the tank to the engine hooking on either side of the tee as to flow through it. In the line between the tee and the suction tank, or attached to the tank side of the tee, there may be a check valve or a manual valve to allow the engine to either automatically or manually start sucking from the tank instead of the gravity system.

The fuel delivery assembly of the present invention uses only the force of gravity to supply fuel from a bulk storage tank to separate fuel tanks of pumps, trucks and other equipment on a fracking location. As such, there is no risk of over-pressuring fuel lines if a pump's internal or external pressure regulator fails. The fuel delivery assembly of the present invention does not require any wires, electronics, or computers to keep fuel tanks full. Further, the fuel delivery assembly of the present invention can fuel a plurality of different fuel tanks from one main supply tank with smaller feeder lines; such feeder lines run a relatively short distance from said supply tank to the tanks that are to be refueled.

Because the gravity system utilizes dry break connections, an individual can disconnect the dry break connections from a gravity fed unit in the event of a fire in order to eliminate a potential fire from following hoses with fuel in them back to the bulk tank. Additionally, after rig up, the fuel delivery assembly of the present invention can be easily monitored remotely or by relatively few personnel which can result in significant cost savings.

BRIEF DESCRIPTION OF THE DRAWINGS/FIGURES

The foregoing summary, as well as any detailed description of the embodiments, is better understood when read in conjunction with the drawings and figures contained herein. For the purpose of illustrating the invention, the drawings and figures show certain embodiments. It is understood, however, that the invention is not limited to the specific methods and devices disclosed in such drawings or figures.

DETAILED DESCRIPTION

The present invention includes a fluid delivery assembly for distributing fuel or other fluid in a safe and controlled manner to fuel tanks of one or more pump trucks or other equipment powered using an internal combustion engines, a turbine, or any other similar type of engine or motor. For example, in some embodiments, the fluid delivery assembly of the present invention can be used to deliver liquid fuel from a bulk storage tank to the individual fuel tanks of multiple trucks, high-pressure pumps and/or other powered equipment—sometimes referred to as a "spread"—situated on a location where fracking operations are performed. In such embodiments, the fuel delivery assembly may be referred to as a bulk storage tank assembly.

In some embodiments, the fuel delivery assembly of the present invention generally includes a central bulk fluid tank (such as a bulk storage tank or container), ideally having sufficient capacity to store and supply fuel to at least one complete pump truck fleet used to conduct a conventional fracking operation. Additionally, said fluid delivery assembly further includes a hydraulic power pack capable of selectively raising and lowering said central bulk fluid tank, and also engaging a plurality of stabilizing legs for supporting said bulk fluid tank in an elevated position. Said bulk fluid tank further includes a plurality of supply boxes for storing fixtures, fittings, connections, hoses and assemblies required for conventional fracking operations.

As described in the disclosure, distribution or flow of fuel from said bulk fluid tank is powered by gravity. Said bulk fluid tank can be selectively raised to a higher elevation than the highest equipment fuel tank on a fracking location using at least one fluid-powered (typically hydraulic) cylinder. A plurality of conduits extends from said bulk fluid tank to multiple equipment fuel tanks to be supplied with fuel. All connections include a "dry break", or a no-drip connection, in order to prevent any spills in the event of inadvertent disconnection of any such conduit from said bulk fluid tank or any intermediate conduits.

Figure 1:
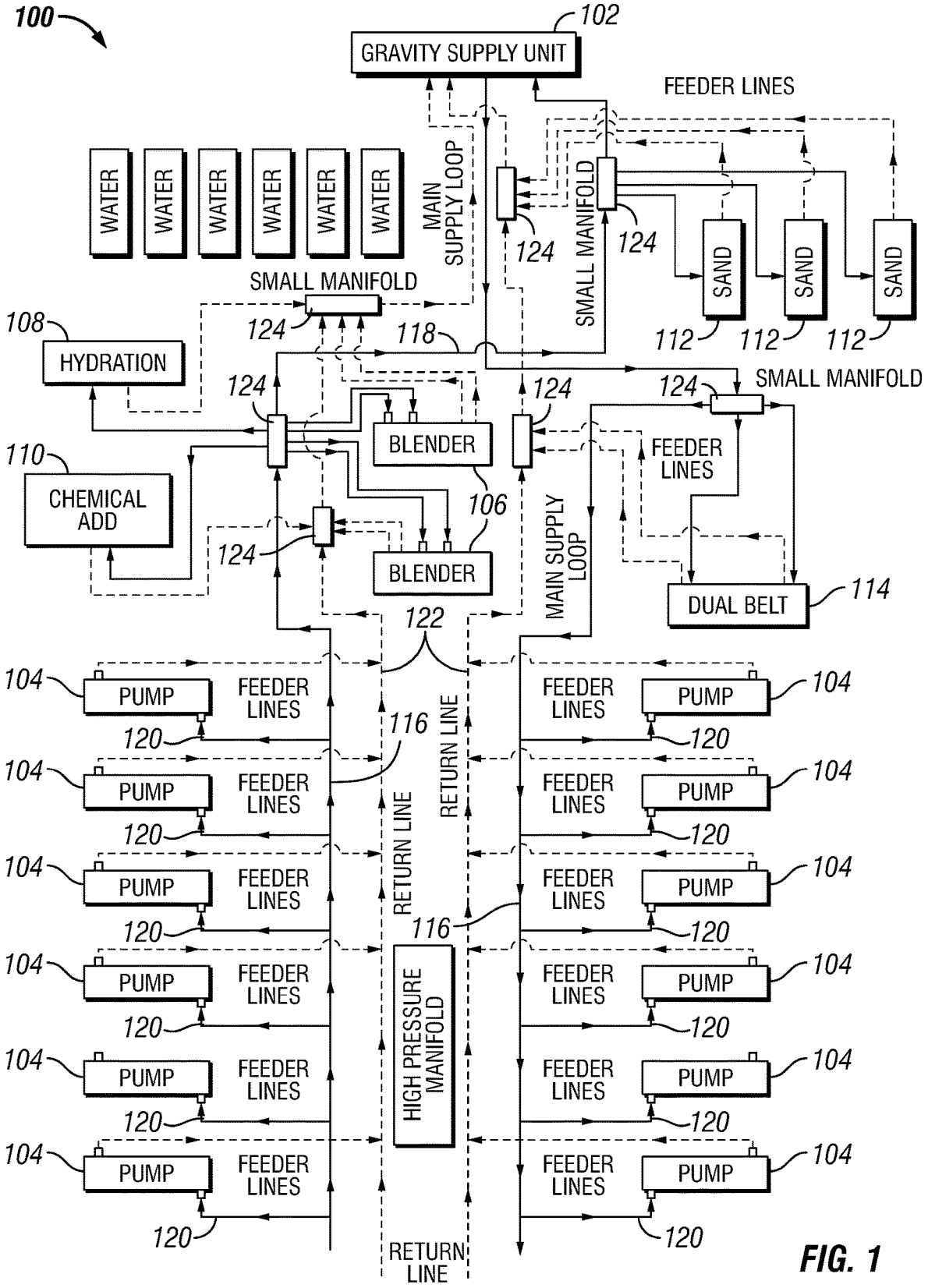
FIG. 1 depicts a schematic view of a proposed layout of a fueling system of the present invention.

FIG. 1 depicts a schematic view of a representative layout of a fuel delivery system 100 of the present invention utilized in connection with a conventional hydraulic fracturing operation. In some embodiments, the bulk fuel tank (labeled "Gravity Supply Unit 102") provides fuel to multiple internal combustion engines, including an array of high pressure pumps 104 and ancillary equipment used during the fracking operation (such as, for example, blenders 106, hydration units 108, chemical addition units 110, sand belts 112, dual belt 114, etc.) As depicted in FIG. 1, main supply lines 116 can be formed as a main supply loop 118 to supply fuel to individual feeder lines 120 which, in turn, route fuel directly to said engines. As well as a supply line to the engines, a return line 122 is also required to take the return fuel from the engines back to the bulk tank.

Figure 2:
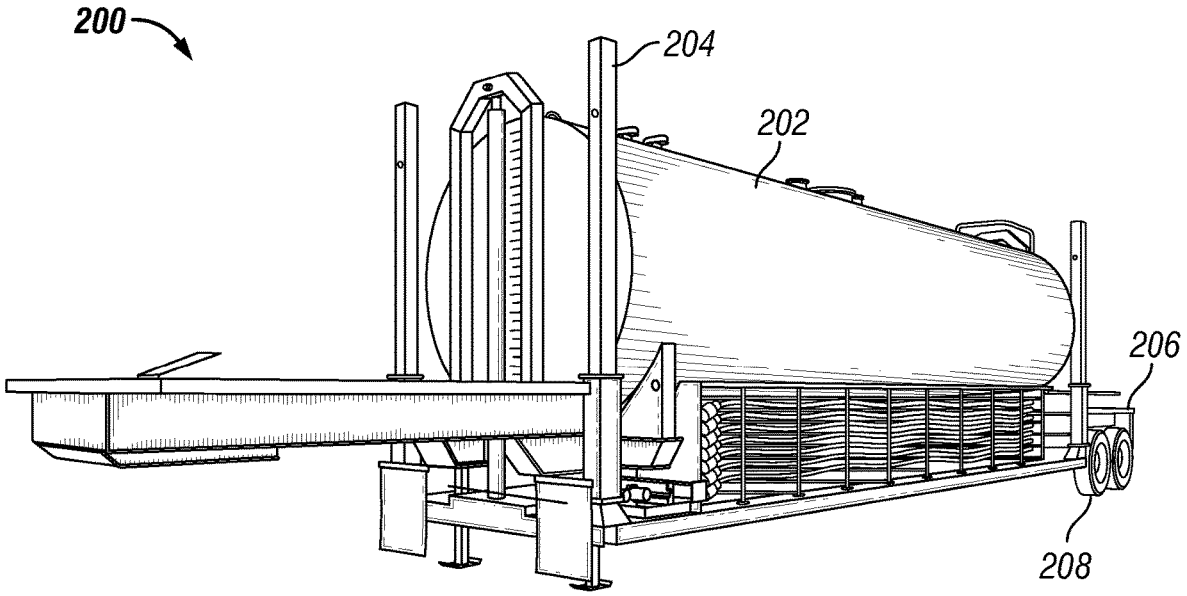
FIG. 2 depicts a side perspective view on the driver's side of a bulk storage tank assembly of the present invention in a collapsed configuration, such as for transport.
Figure 3:
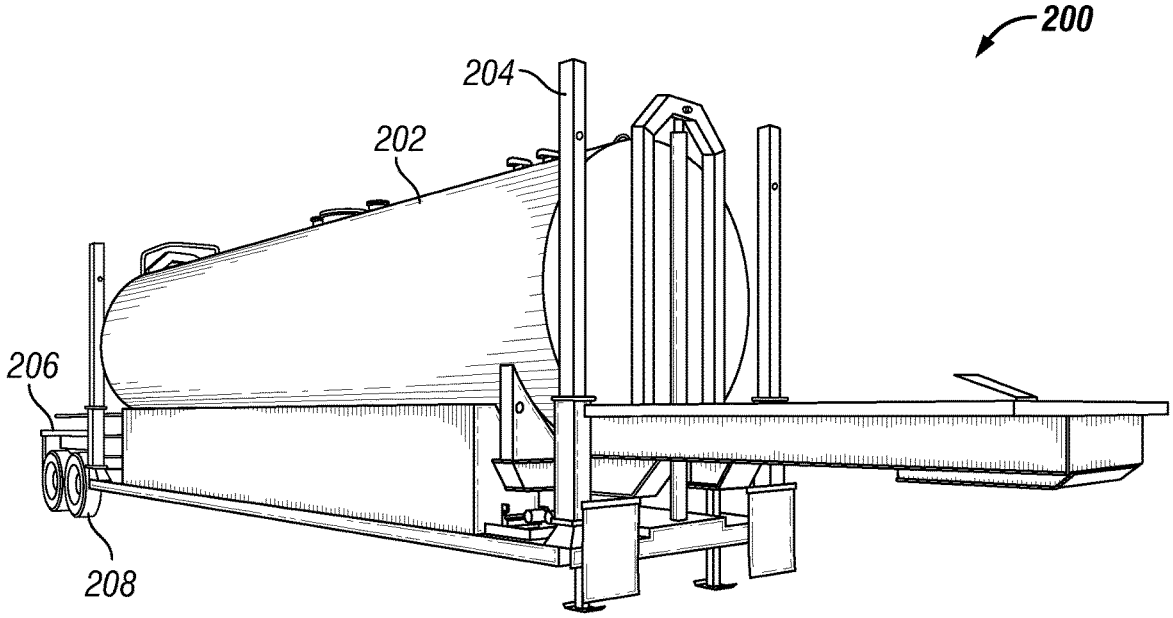
FIG. 3 depicts a side perspective view on the passenger side of a bulk storage tank assembly of the present invention in a collapsed configuration, such as for transport.

FIGS. 2 and 3 depict a side perspective views of a bulk storage tank assembly 200 (also referred to as a "fuel delivery assembly 200") of the present invention in a collapsed configuration, such as for transport. In some embodiments, the fuel delivery assembly 200 of the present invention generally includes a central bulk fluid tank 202 (such as a bulk storage tank or container), ideally having sufficient capacity to store and supply fuel to at least one complete pump truck fleet and ancillary equipment used to conduct a conventional fracking operation.

Located directly behind a front deck (or, the fifth wheel), a hydraulically raised and lowered central bulk fluid tank 202 with an external frame 204, also acting as a trailer frame, can connect the fifth wheel to a plurality of tractor tires when in transport mode. Central bulk fluid tank can be lowered, as necessary, in order to meet any legal Department of Transportation (DOT) height restrictions. Located behind central bulk fluid tank is a rear deck 206 located above a plurality of trailer tires 208. Additionally, a plurality of plumbing and valves to control, by way of illustration, but not limitation, fuel flow, will be located on the unit.

In addition, the bulk storage tank assembly 200 includes a plurality of supply boxes in order to hold all necessary fixtures, connections, hoses and assemblies for an entire fracking operation. In some embodiments, a plurality of small manifolds (shown as 124 in FIG. 1) that can be carried by hand will also be stored on the unit. As shown in FIG. 1, these manifolds 124 will be placed in a desired location in the main supply loop to feed blenders, hydrations, chemical adds, sand equipment etc.

Figure 4:
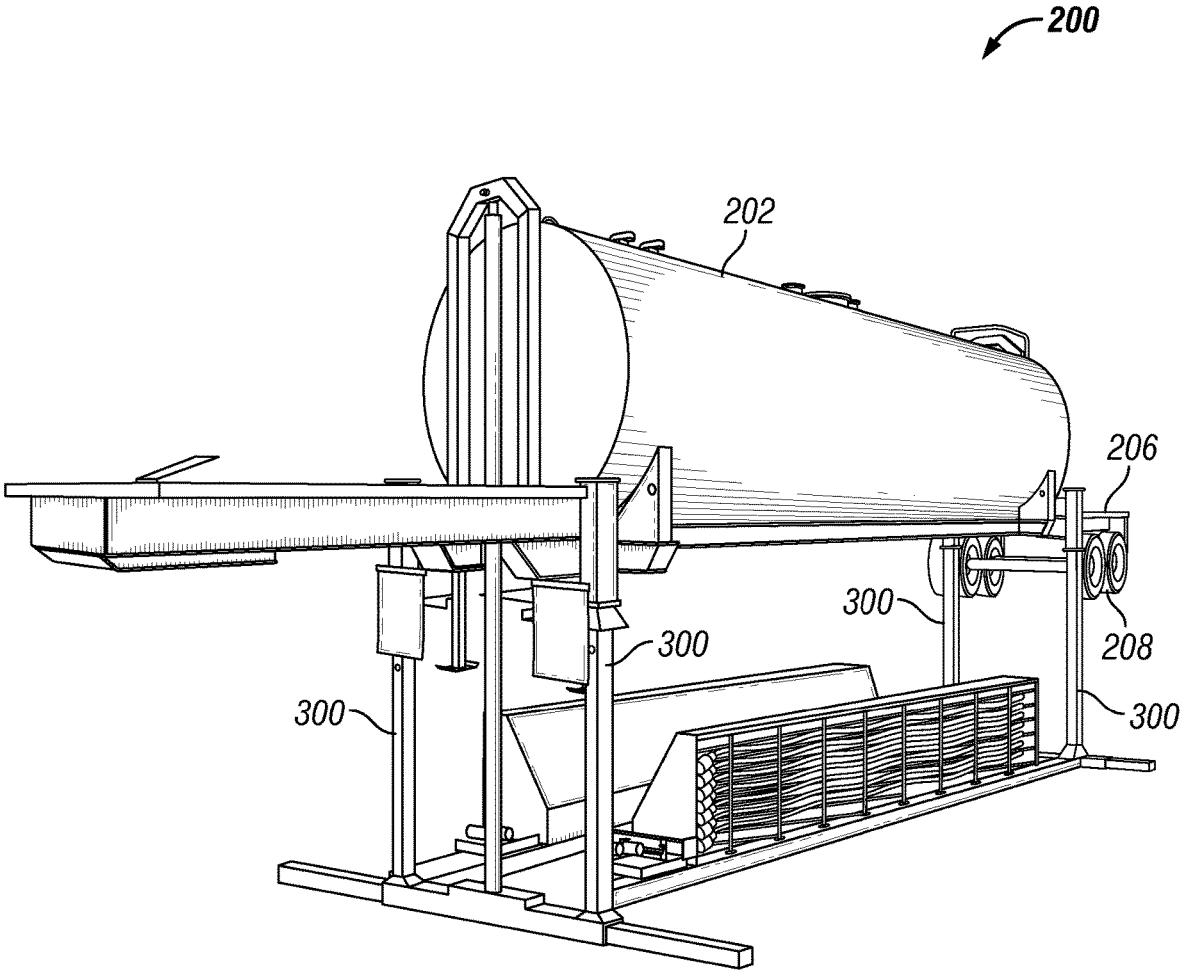
FIG. 4 depicts a side perspective view on the driver's side of a bulk storage tank assembly of the present invention in a raised orientation for operation.
Figure 5:
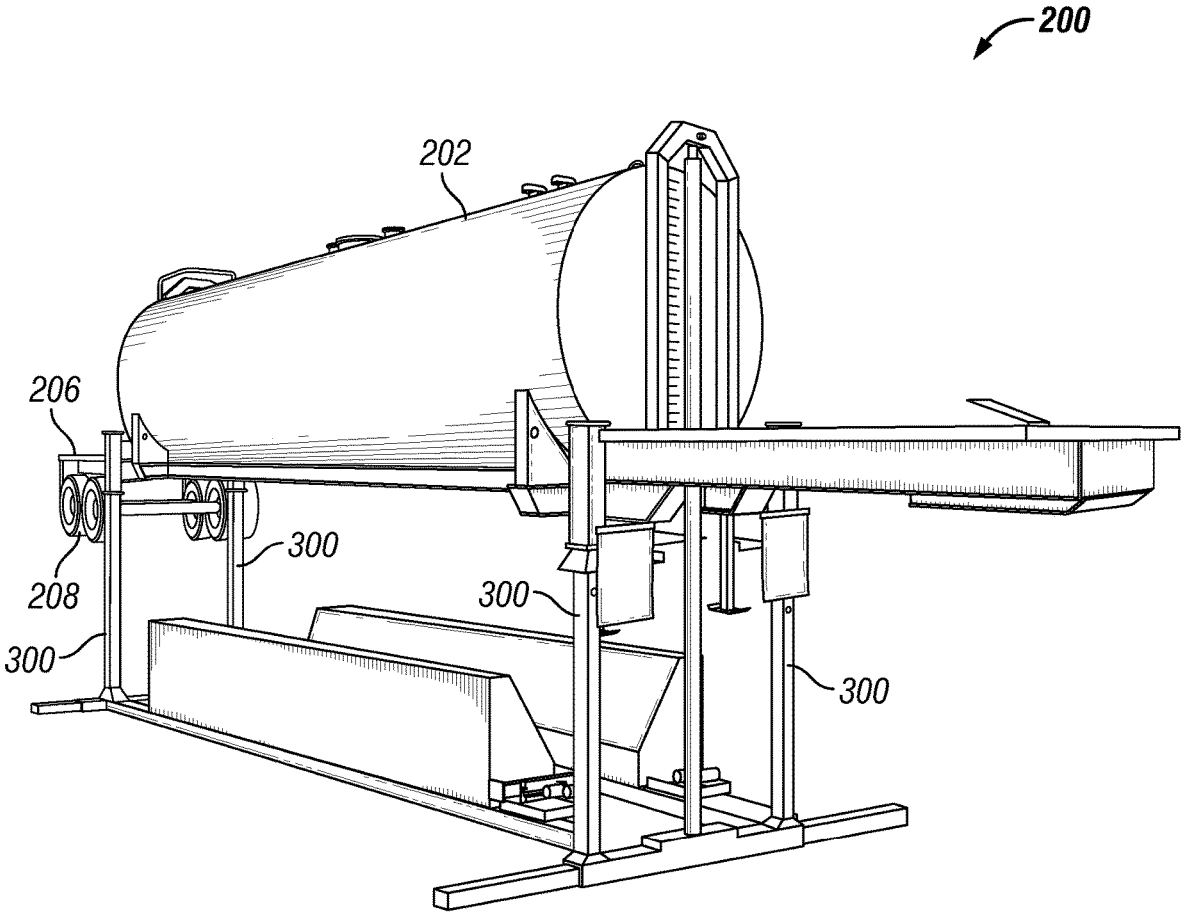
FIG. 5 depicts a side perspective view on the passenger side of a bulk storage tank assembly of the present invention in a raised orientation for operation.

FIGS. 4 and 5 depict side perspective views of a bulk storage tank 202 of the present invention in a raised orientation for operation. The bulk storage tank assembly 200 includes a hydraulic power pack capable of selectively raising and lowering said central bulk fluid tank 202, and also engaging a plurality of stabilizing legs 300 for supporting said bulk fluid tank 202 in an elevated position. Additionally, bulk storage tank assembly 200 includes at least one angle brace that can be manually put into place in order to provide lateral stability to bulk fluid tank 202 when fluid tank is raised. Said bulk fluid tank 202 further includes a plurality of supply boxes for storage of items typically required for conventional fracking operations.

As described in the disclosure, distribution of fuel from said bulk fluid tank 202 is powered by gravity. Raising said bulk fuel storage tank 202 to a desired elevation on a fracking location provides a sufficient gravity head to deliver fuel from said bulk fuel tank 202 to individual trucks and/or other equipment on a location. Said bulk fluid tank 202 can be selectively raised to a higher elevation than the highest equipment fuel tank on a fracking location; a plurality of conduits extend from said bulk fluid tank 202 to multiple equipment fuel tanks to be supplied with fuel. All connections include a "dry break", or a no-drip connection, in order to prevent any spills in the event of inadvertent disconnection of any such conduit from said bulk fluid tank.

Dry break connections can be disconnected from said fuel delivery system in order to eliminate a potential fire from following the conduits or hoses back to the bulk tank. Additionally, the fuel delivery system of the present invention can be moved onto a location, rigged up, operated and rigged down quickly and efficiently.

Figure 6:
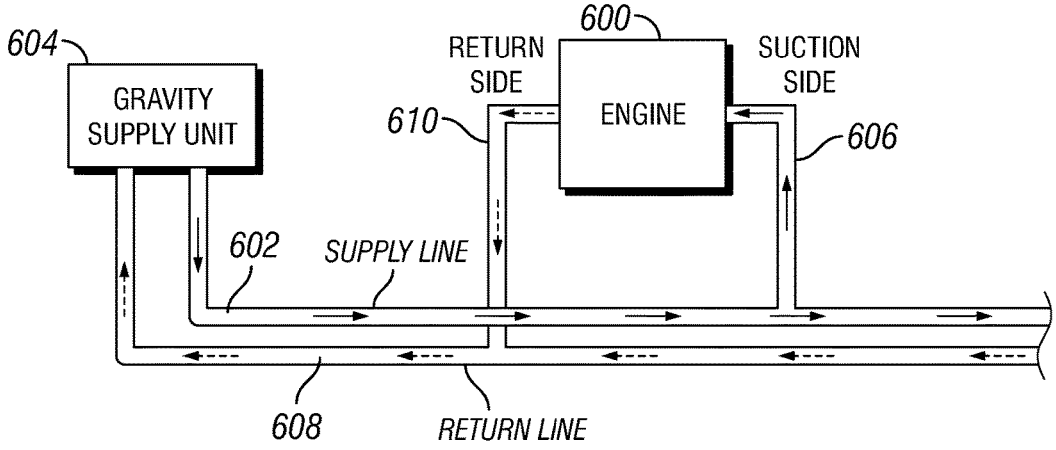
FIG. 6 is a schematic diagram of a general layout of the supply and return (discharge) lines running to an engine.

FIG. 6 depicts a general layout of the supply and return lines running to an engine 600. FIG. 6 depicts a supply line 602 (which may include a feeder line) from a bulk fluid tank (referred to as Gravity Supply Unit 604) to the suction side 606 of the engine fuel system and a return line 608 from the return side 610 of the engine fuel system back to the bulk fluid tank (Gravity Supply Unit 604).

Figure 7:
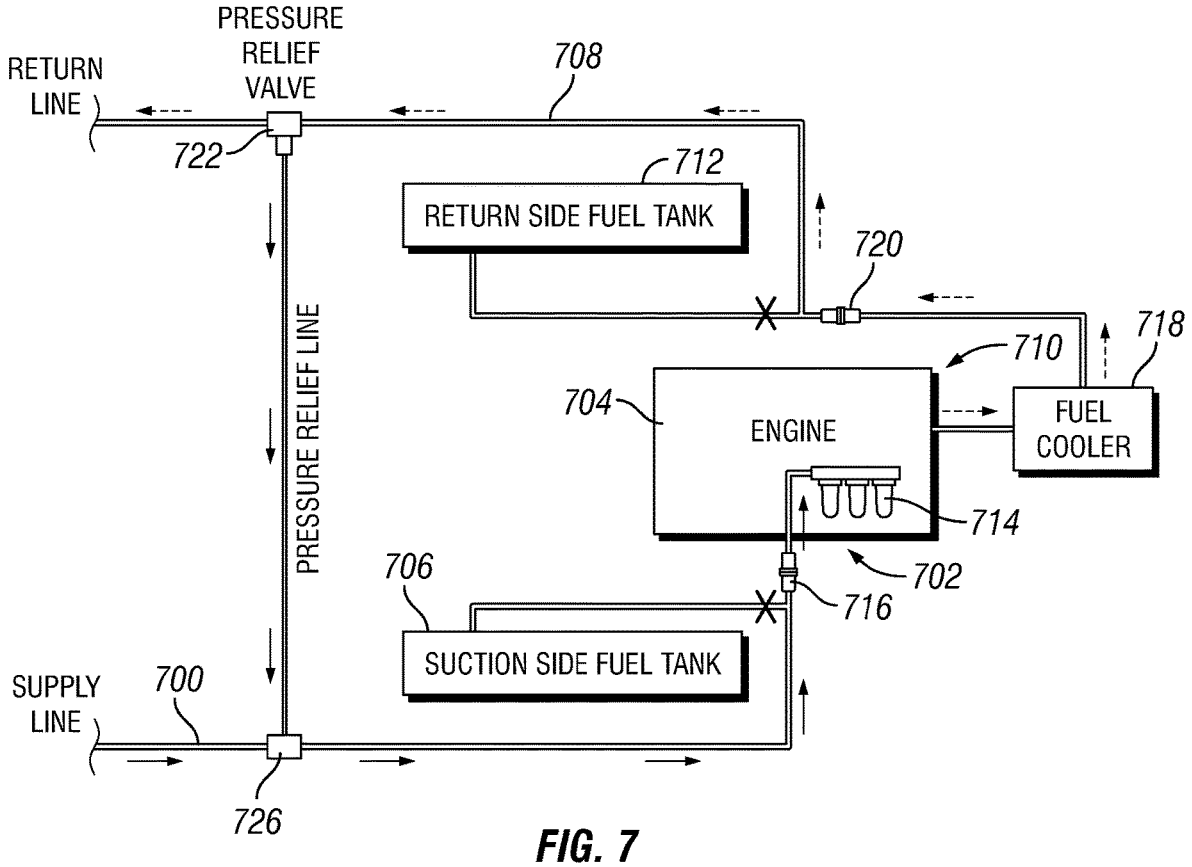
FIG. 7 is a schematic diagram of a first embodiment wherein the engine's fuel tanks are completely bypassed.

FIG. 7 depicts a first embodiment wherein the engine's fuel tanks are completely bypassed. FIG. 7 depicts a supply line 700 (which may include a feeder line) from a bulk fluid tank to the suction side 702 of the engine 704 fuel system that bypasses the suction side fuel tank 706 and a return line 708 from the return side 710 of the engine 704 fuel system back to the bulk fluid tank that by passes the return side fuel tank 712. As shown in FIG. 7, the supply line 700 may be connected to fuel filters 714 via a flat face quick connection 716. The return line 708 may be connected to the fuel cooler 718 via a flat face quick connection 720. FIG. 7 also depicts a low pressure relief valve 722 on the return (discharge) side 710 of the engine 704 fuel system. The pressure relief valve 722 is connected to a pressure relief line 724 connected to the supply line 700 (for example, via a tee connection 726). The pressure relief valve 722 protects the fuel system and its components in the event that there is a blockage between the return side 710 of the engine's fuel system and the bulk supply tank and enables the relief of pressure via discharge into the supply line 700.

Figure 8:
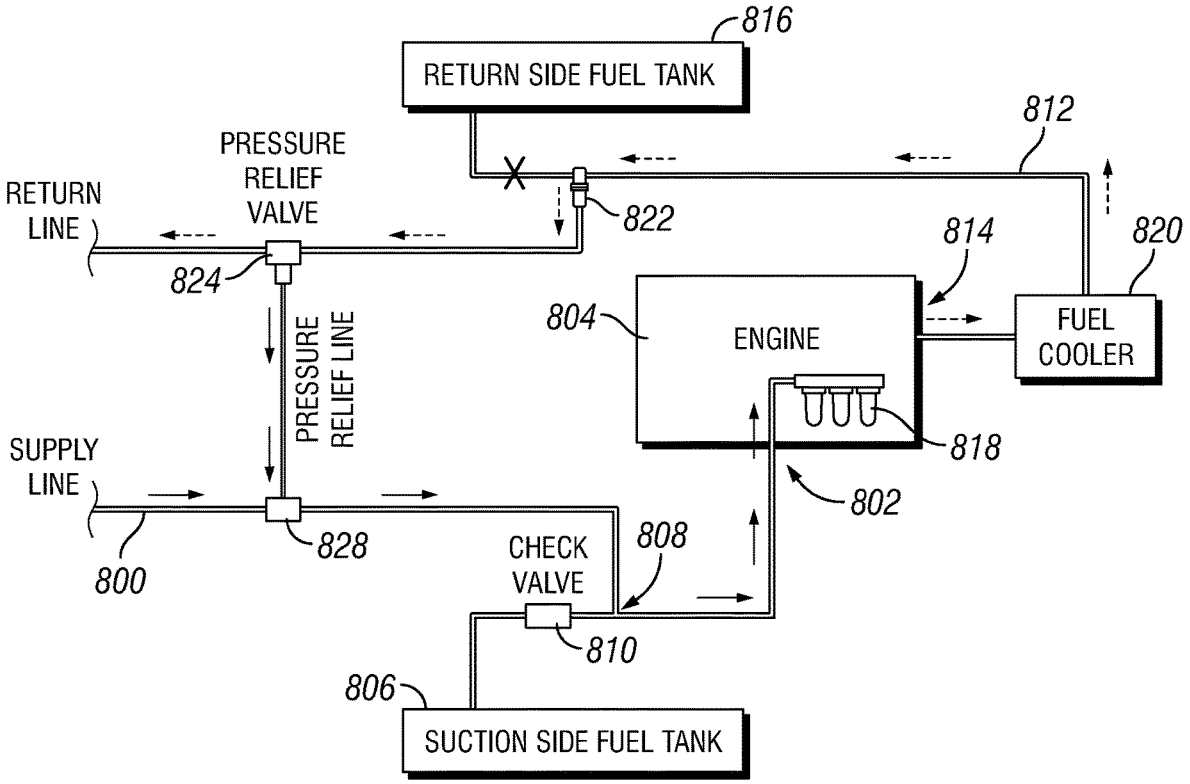
FIG. 8 is a schematic diagram of a second embodiment wherein the engine's suction line has a tee with a check valve, or manual valve, between the tank and the tee.

FIG. 8 depicts a second embodiment wherein the suction side fuel tank is not completely bypassed. FIG. 8 depicts a supply line 800 from a bulk fluid tank to the suction side 802 of the engine 804 fuel system that is connected to the suction side fuel tank 806 via a tee connector 808. In such embodiments, a check value 810 or manual valve is located between the suction side fuel tank 806 and the tee connector 808 or located at the tank side of the tee connector 808. The check valve 810 or manual valve may allow the engine 804 to automatically or manually suck fuel from the suction side fuel tank 806 instead of the gravity-fed system. FIG. 8 also shows a return line 812 from the return side 814 of the engine 804 fuel system back to the bulk fluid tank that by passes the return side fuel tank 816. In some embodiments, the supply line 800 may be connected to fuel filters 818 via a flat face quick connection. In some embodiments, the return line 812 may be connected to the fuel cooler 820 via a flat face quick connection 822. FIG. 8 also depicts a low pressure relief valve 824 on the return (discharge) side 814 of the engine 804 fuel system. The pressure relief valve 824 is connected to a pressure relief line 826 connected to the supply line 800 (for example, via a tee connection 828). The pressure relief valve 824 protects the fuel system and its components in the event that there is a blockage between the return side 814 of the engine's fuel system and the bulk supply tank and enables the relief of pressure via discharge into the supply line 800.

The fuel delivery assembly of the present invention uses only gravitational force to supply fuel to fuel tanks of trucks and/or other equipment. Because only gravitational force is utilized, there is no risk of over pressuring fuel lines if a pump's internal or external pressure regulator fails. The fuel delivery assembly of the present invention does not require any wires, electronics, or computers to keep the engines supplied with fuel. The gravity fed system is unique in that it supplies consistent and even pressure without the risk of over pressuring the engine's fuel system. If the system relied on pumps and regulators to supply pressure, it would be much more difficult to get the right pressure to each engine especially as demand and flow changed throughout the job as the engines burned more and less fuel.

The fuel delivery assembly of the present invention eliminates the need for personnel to enter "high pressure zone" restricted areas. During most conventional fracking operations, as well as other industrial applications involving high pressure pumping, a high pressure zone is designated. Access to said high pressure zone by personnel is limited or restricted during such pumping operations. The fuel delivery assembly of the present invention automatically keeps the fuel tanks filled to a predetermined level without requiring personnel to enter said restricted high pressure zone to add fuel to trucks or pumps.

Once the fracking operation has been completed, in order to disconnect the fuel delivery assembly, fuel flow will be shut off at the main central bulk fluid tank. All of the relatively small feeder lines will be disconnected from the main supply lines. All of the lines will be stored with fuel in them, since said lines are all equipped with dry break connections. All of the lines will be put away in their designated storage areas. The central bulk fluid tank will be emptied of any additional fuel for transport. Thus, the tank will be lowered, the stabilizing legs will be lifted, and the entire assembly will be moved and transported to the next desired location.

The above-described invention has a number of particular features that may be employed in combination, although each is useful separately without departure from the scope of the invention. While embodiments of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for supplying fuel to at least one internal combustion engine comprising:

a) a bulk storage tank containing fuel, wherein said bulk storage tank is adapted to be raised to a higher elevation than an inlet of a fuel tank of said at least one internal combustion engine;

b) a first conduit having a first end and a second end, wherein said first end is in fluid communication with said bulk storage tank and said second end is attached to a suction side of the engine's fuel system; and c) a second conduit having a first end and a second end, wherein said first end is in fluid communication with said bulk storage tank and second end is attached to the return side of the engines fuel system;

d) a pressure relief valve connected to said second conduit;

e) a pressure relief line having a first end connected to the pressure relief valve and a second end connected to the first conduit.

2. The apparatus of claim 1, further comprising at least one fluid powered cylinder adapted to selectively raise and lower said bulk storage tank.

3. The apparatus of claim 1, wherein said bulk storage tank is trailer mounted.

4. The apparatus of claim 1, wherein said at least one internal combustion engine powers a fluid pump on a hydraulic fracturing location.

5. A method for delivering fuel to an internal combustion engine, comprising:

a) providing a bulk storage tank containing fuel;

b) installing a first conduit from said bulk storage tank to a suction side of a fuel system of said internal combustion engine;

c) installing a second conduit from a discharge side of the fuel system of said internal combustion engine to said bulk storage tank;

d) installing a pressure relief valve connected to said second conduit from said discharge side of said fuel system;

e) installing a pressure relief line having a first end connected to the pressure relief valve and a second end connected to the first conduit;

f) raising said bulk storage tank to an elevation above said fuel tank; and g) allowing fuel to gravity flow from said bulk storage tank through said first conduit to supply fuel to said internal combustion engine.

6. The method of claim 5, wherein raising said bulk storage tank to the elevation above said fuel tank further comprises raising said bulk storage tank using at least one fluid powered cylinder adapted to selectively raise and lower said bulk storage tank.

7. The method of claim 5, wherein said bulk storage tank is trailer mounted.

8. The method of claim 5, wherein said internal combustion engine powers a fluid pump at a hydraulic fracturing location.

9. The method of claim 5, comprising providing a pressure relief valve connected to said second conduit from said discharge side of said fuel system.

10. The method of claim 5, comprising supplying fuel directly to said internal combustion engine and bypassing a suction side fuel tank.

11. The method of claim 5, comprising providing a valve between a suction side fuel tank and said first conduit, wherein the valve is configured to enable a supply of fuel from said suction side fuel tank to said internal combustion engine.

12. The method of claim 11, wherein the valve comprises a check valve or a manual valve.

* * * * *